US009327394B2

(12) United States Patent
Chang

(10) Patent No.: US 9,327,394 B2
(45) Date of Patent: May 3, 2016

(54) CLAW HAMMER

(71) Applicant: Hsiu-Hua Chang, Taichung (TW)

(72) Inventor: Hsiu-Hua Chang, Taichung (TW)

( * ) Notice: Subject to any disclaimer, the term of this patent is extended or adjusted under 35 U.S.C. 154(b) by 46 days.

(21) Appl. No.: 14/276,978

(22) Filed: May 13, 2014

(65) Prior Publication Data

US 2015/0328758 A1 Nov. 19, 2015

(51) Int. Cl.
*B66F 15/00* (2006.01)
*B25D 1/12* (2006.01)
*B25D 1/04* (2006.01)

(52) U.S. Cl.
CPC ... *B25D 1/12* (2013.01); *B25D 1/04* (2013.01)

(58) Field of Classification Search
USPC ..... 254/26 R
See application file for complete search history.

(56) References Cited

U.S. PATENT DOCUMENTS 1,144,035 A * 6/1915 Guy ..... B25D 1/12 81/22
5,029,496 A * 7/1991 Catania ..... B25G 1/01 81/22
5,280,738 A * 1/1994 Liou ..... B25D 1/00 81/177.8
6,128,977 A * 10/2000 Gierer ..... B25D 1/12 7/144
6,945,138 B1 * 9/2005 Kreitzer ..... B25D 1/045 30/308.1
2006/0005667 A1 * 1/2006 Hung ..... B25D 1/12 81/22
2006/0207391 A1 * 9/2006 Chen ..... B25D 1/045 81/22
2012/0186399 A1 * 7/2012 Chen ..... B25D 1/12 81/22
2014/0260812 A1 * 9/2014 Chang ..... B25D 1/12 81/22

FOREIGN PATENT DOCUMENTS

DE 202011000320 U1 * 9/2011 ..... B25D 1/12

* cited by examiner

*Primary Examiner* — Lee D Wilson
*Assistant Examiner* — Alvin Grant

(57) ABSTRACT

A shock-reducing claw hammer includes a hammerhead, a handle and a restraining element. The hammerhead includes a hitting portion formed at an end and two claws formed at another end. The handle is connected to the hammerhead and formed with a bore, a gap in communication with the bore, and a reduced portion so that the bore is located between the gap and the reduced portion. The restraining element includes a flat body and two end tabs extending from the flat body. The flat body is supported on the handle. One of the end tabs is movably inserted in the wide slit. The other end tab is fitted in the narrow slit.

6 Claims, 8 Drawing Sheets

CLAW HAMMER

BACKGROUND OF INVENTION

1. Field of Invention

The present invention relates to a hammer and, more particularly, to a claw hammer.

2. Related Prior Art

A claw hammer is used to pound a nail into wood or extract a nail from wood for example. The claw hammer includes a head connected to an end of a handle. The head includes a substantially flat face at an end and two claws at another end.

To pound a nail into wood, the claw hammer is swung to bring the flat face of the head into contact with the nail. Most of the energy of the claw hammer is transferred to the nail. Thus, the nail is pounded into the wood. It is however inevitable that some of the energy of the claw hammer is absorbed by a user's hand with which the handle is held so that the user easily feels tired in the hand.

To extract a nail from wood, the claw hammer is moved to bring the pair of claws into engagement with the nail and the head into contact with the wood. Then, the claw hammer is pivoted. Thus, the nail is extracted from the wood. The wood could be damaged by the head.

Therefore, the present invention is intended to obviate or at least alleviate the problems encountered in prior art.

SUMMARY OF INVENTION

It is the primary objective of the present invention to provide a shock-reducing claw hammer.

To achieve the foregoing objective, the claw hammer includes a hammerhead, a handle and a restraining element. The hammerhead includes a hitting portion formed at an end and two claws formed at another end. The handle is connected to the hammerhead and formed with a bore, a gap in communication with the bore, and a reduced portion so that the bore is located between the gap and the reduced portion. The restraining element includes a flat body and two end tabs extending from the flat body. The flat body is supported on the handle. One of the end tabs is movably inserted in the wide slit. The other end tab is fitted in the narrow slit.

Other objectives, advantages and features of the present invention will be apparent from the following description referring to the attached drawings.

BRIEF DESCRIPTION OF DRAWINGS

The present invention will be described via detailed illustration of four embodiments referring to the drawings wherein.

DETAILED DESCRIPTION OF PREFERRED EMBODIMENT

Figure 1:
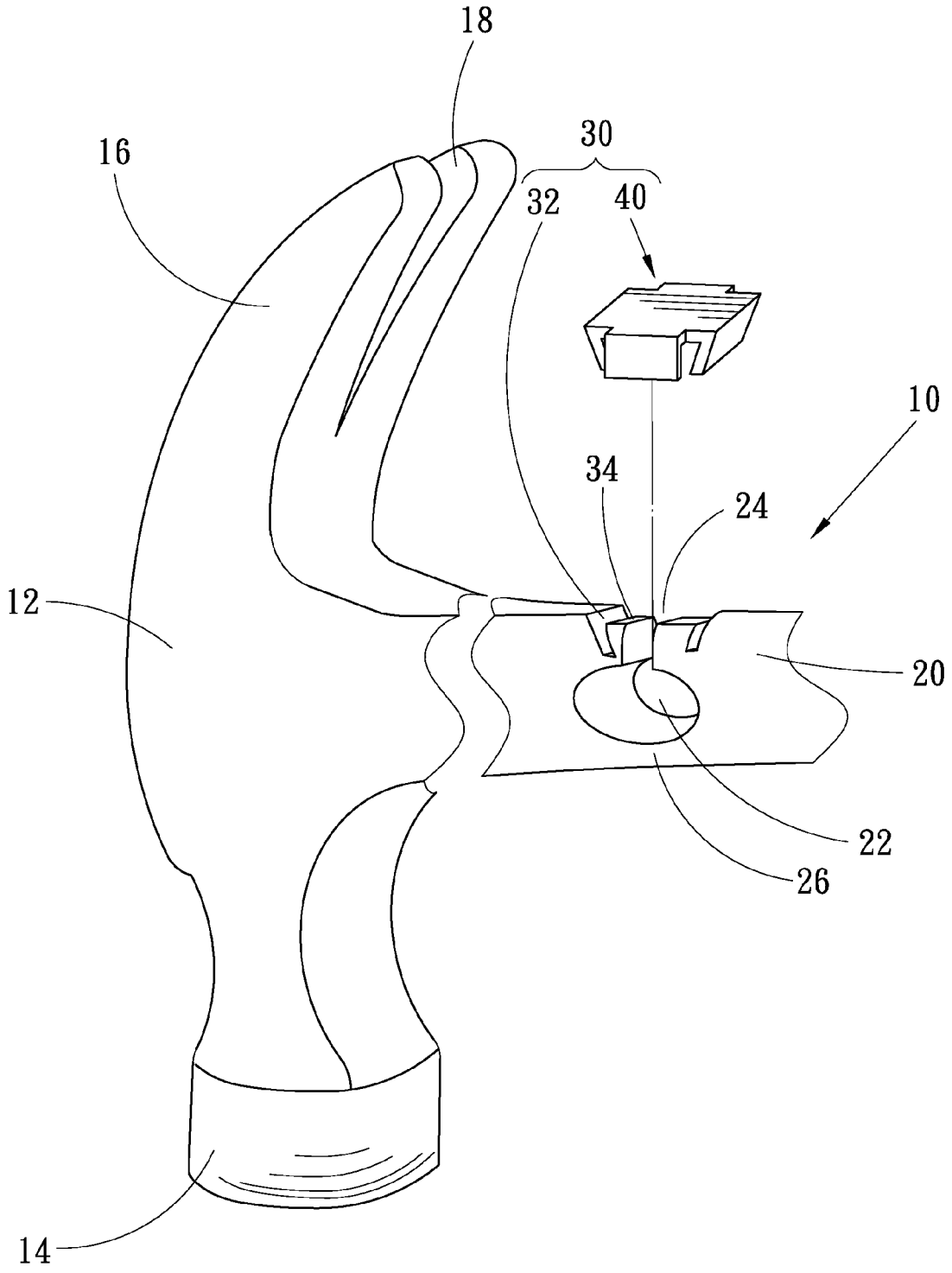
FIG. 1 is an exploded view of a shock-reducing claw hammer according to the first embodiment of the present invention.
Figure 2:
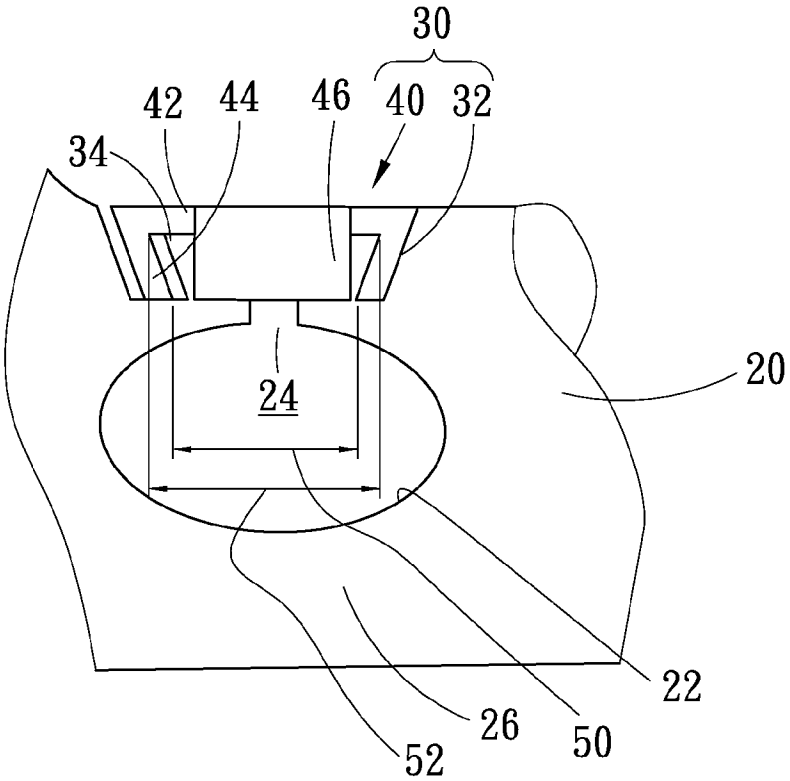
FIG. 2 is a partial, side view of the shock-reducing claw hammer shown in FIG. 1.
Figure 3:
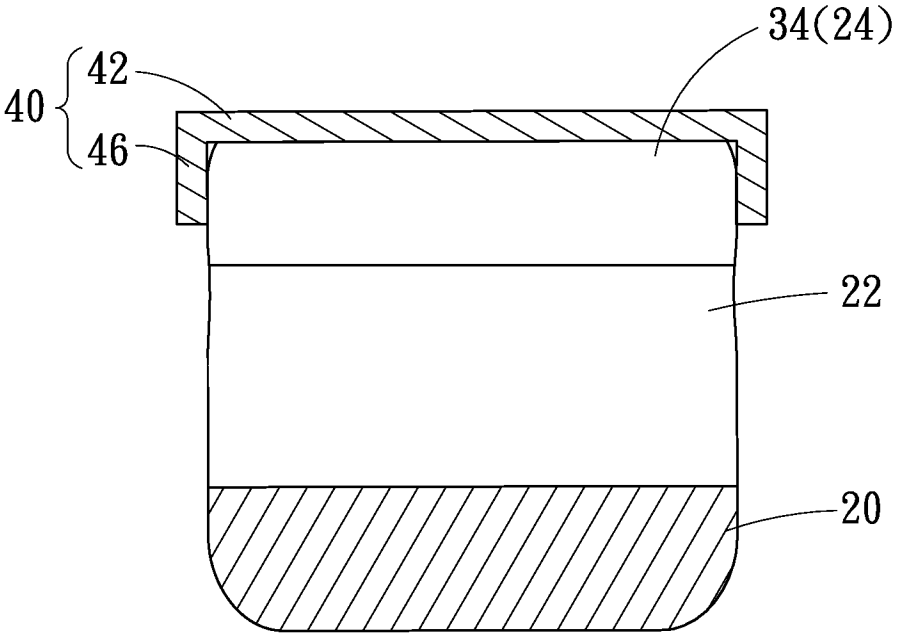
FIG. 3 is a cross-sectional view of the shock-reducing claw hammer shown in FIG. 1.

Referring to FIGS. 1-3, a shock-reducing claw hammer 10 includes a hammerhead 12, a handle 20 and a restraining device 30 according to a first embodiment of the present invention. The hammerhead 12 includes a hitting portion 14 formed at an end and two claws 16 formed at another end. There is a V-shaped notch 18 between the claws 16.

The handle 20 is connected to the hammerhead 12. The handle 20 and the hammerhead 12 are made one in the first embodiment. The handle 20 and the head can however be made individually and then connected to each other. The handle 20 extends parallel to the hammerhead 12 except the claws 16.

The handle 20 includes a bore 22, a gap 24 and a reduced portion 26. The bore 22 is made in the handle 20 to form the reduced portion 26. The reduced portion 26 renders the handle 20 flexible. The bore 22 can be made by laser, EDM or grinding. The gap 24 is in communication with the bore 22. The bore 22 is located between the gap 24 and the reduced portion 26. The size of the bore 22 and the size of the gap 24 must be carefully determined so that the reduced portion 26 is resilient but strong.

The restraining device 30 includes two slits 32 and a restraining element 40. The slits 32 are made in the handle 20, with the gap 24 located between them. Each of the slits 32 includes an open end and a closed end. The open ends of the slits 32 are further from the bore 22 than the closed ends of the slits 32. The slits 32 get closer to each other as they extend toward the bore 22. That is, a distance 50 between the open ends of the slits 32 is larger than a distance 52 between the closed ends of the slits 32. One of the slits 32 (the "wide slit 32") is wider than the other slit 32 (the "narrow slit 32"). The wide slit 32 is located closer to the hammerhead 12 than the narrow slit 32 in the first embodiment. The wide slit 32 can however be located further from the hammerhead 12 than the narrow slit 32 in another embodiment. A first wedge-like portion 34 is formed between the narrow slit 32 and the gap 24 while a second wedge-like portion 34 is formed between the wide slit 32 and the gap 24.

The restraining element 40 includes a flat body 42, two end tabs 44 and two lateral tabs 46. The flat body 42 is a rectangular plate with two short sides and two long sides. The end tabs 44 extend from the short sides while the lateral tabs 46 extend from the long sides. The thickness of the end tabs 44 is identical to the width of the narrow slit 32. The lateral tabs 46 extend parallel to each other.

The flat body 42 is located on the wedge-like portions 34. The flat body 42 is flush with the handle 20 because the wedge-like portions 34 are located lower than the handle 20 as shown in FIG. 2. The first end tab 44 is fitted in the narrow slit 32 so that the first end tab 44 is not movable in the narrow slit 32. The second end tab 44 is movably inserted in the wide slit 32. Each of the lateral tabs 46 is in contact with the wedge-like portions 34.

Figure 4:
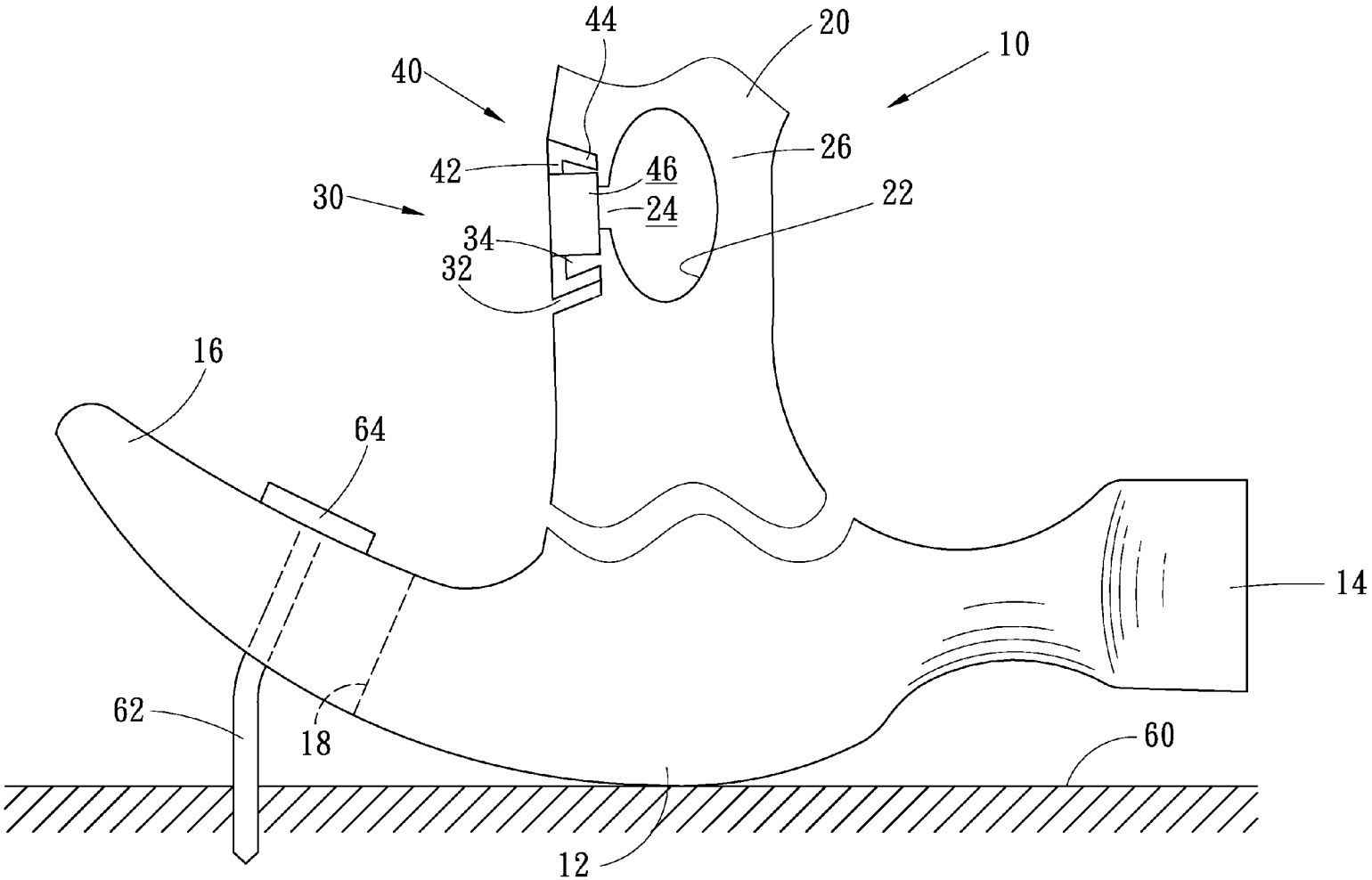
FIG. 4 is a partial, side view of the shock-reducing claw hammer shown in FIG. 1 used to extract a nail from wood.

Referring to FIG. 4, the shock-reducing claw hammer 10 is used to extract a nail 62 from wood 60. The nail 62 is made with a head 64. The claws 16 are brought into engagement with the head 64 of the nail 62 while the hammerhead 12 of the shock-reducing claw hammer 10 is in contact with the wood 60. Then, the shock-reducing claw hammer 10 is pivoted.

At the beginning, the second end tab 44 is away from the second wedge-like portion 34 to allow bending of the reduced portion 26 so that only a small force can be exerted on the nail 62. This small force may be enough to extract the nail 62 from the wood 60. Accordingly, only this small force is exerted on the wood 60. Otherwise, the reduced portion 26 is further bent to bring the second end tab 44 into contact with the second wedge-like portion 34. As the second end tab 44 is in contact with the second wedge-like portion 34, the reduced portion 26 cannot further be bent to allow exertion of a larger force on the nail 62.

Figure 5:
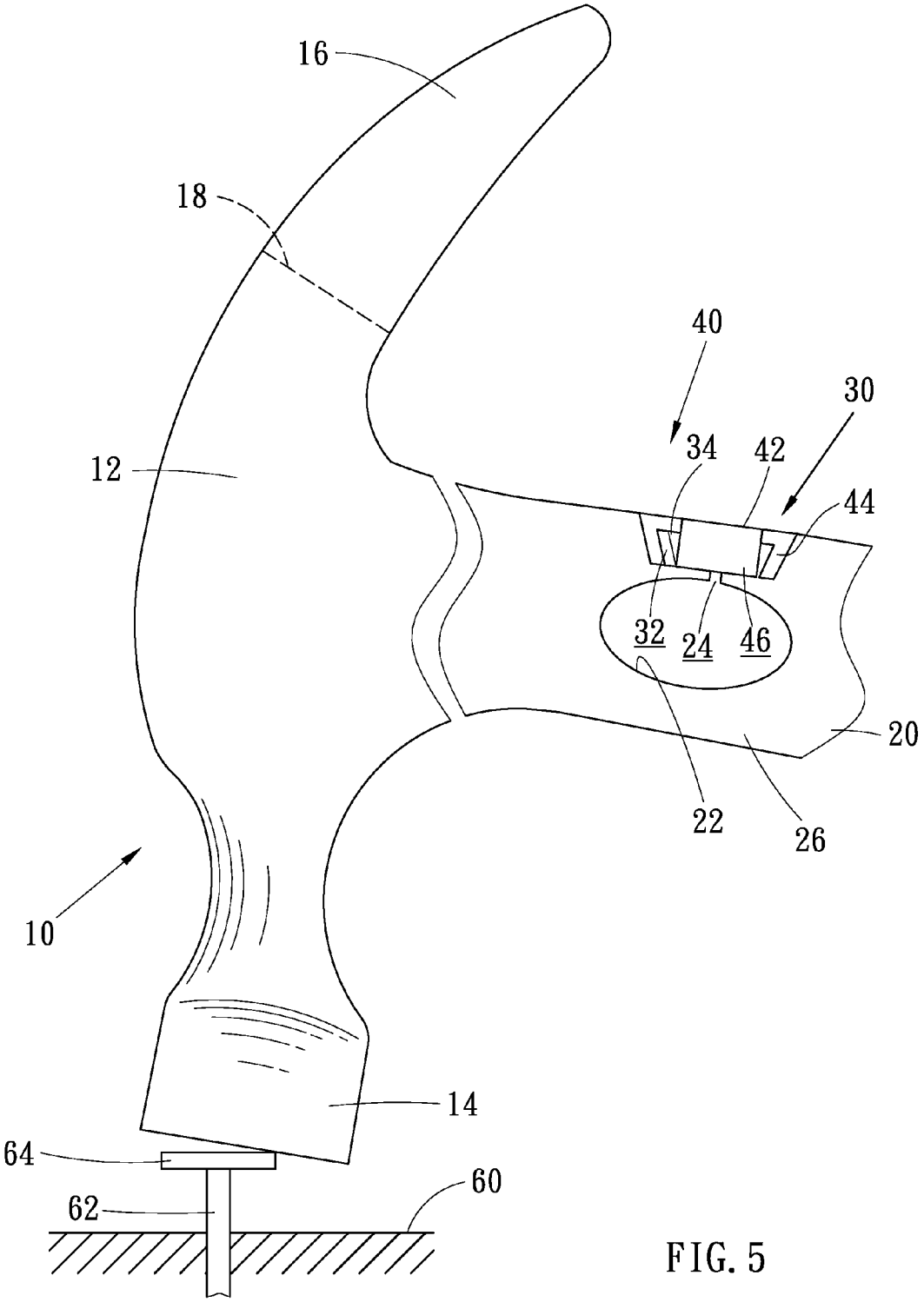
FIG. 5 is a partial, side view of the shock-reducing claw hammer shown in FIG. 1 used to pound a nail into wood.

Referring to FIG. 5, the shock-reducing claw hammer 10 is used to pound the nail 62 into the wood 60. The shock-reducing claw hammer 10 is swung to bring the hitting portion 14 into contact with the head 64 of the nail 62.

At the beginning, the second end tab 44 is away from the handle 20 to allow bending of the reduced portion 26 so that only a small force can be exerted on the nail 62. This small force may be enough to pound the nail 62 into the wood 60. In practice, the reduced portion 26 is used like a leaf spring that would enable the hammerhead 12 to hit the nail 62 several times with each swing of the shock-reducing claw hammer 10.

Otherwise, a user pounds the nail 62 harder with the shock-reducing claw hammer 10. The reduced portion 26 is bent so that the second end tab 44 is brought into contact with the handle 20 and that the reduced portion 26 cannot further be bent. Thus, a large force can be exerted on the nail 62.

Figure 6:
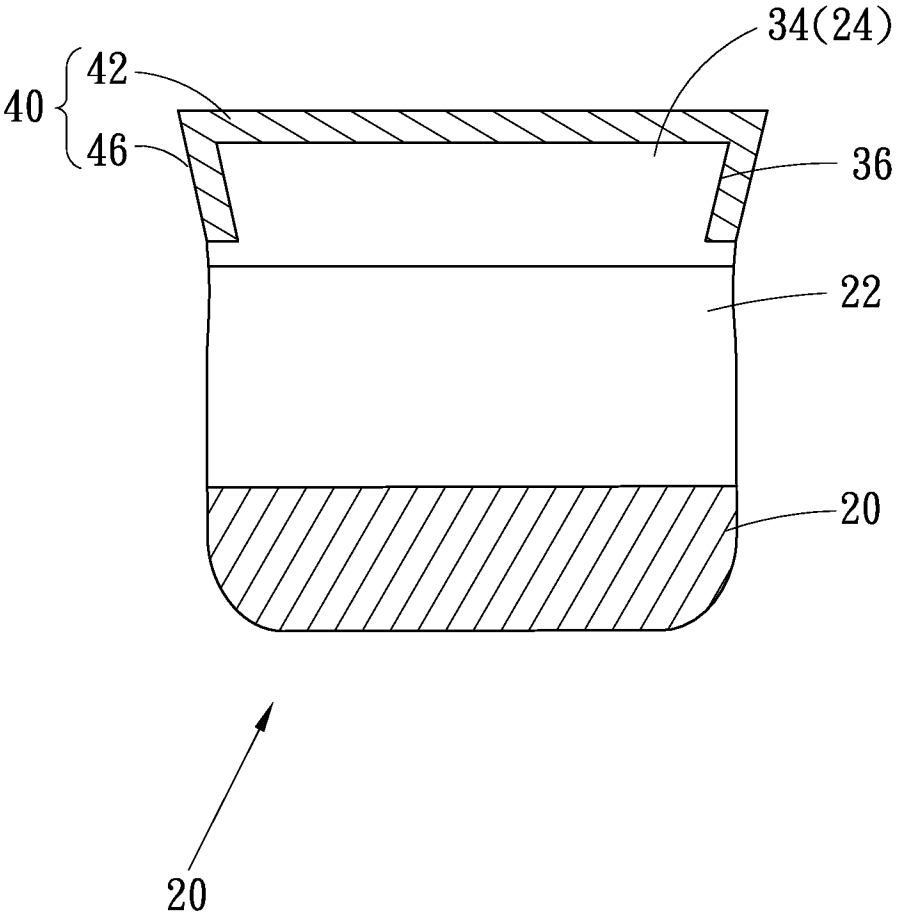
FIG. 6 is a cross-sectional view of a shock-reducing claw hammer according to the second embodiment of the present invention.

Referring to FIG. 6, there is a shock-reducing claw hammer 10 according to a second embodiment of the present invention. The second embodiment is like the first embodiment except that the lateral tabs 46 get closer to each other as they extend towards the bore 22. Tips of the lateral tabs 46 are flush with the handle 20.

Figure 7:
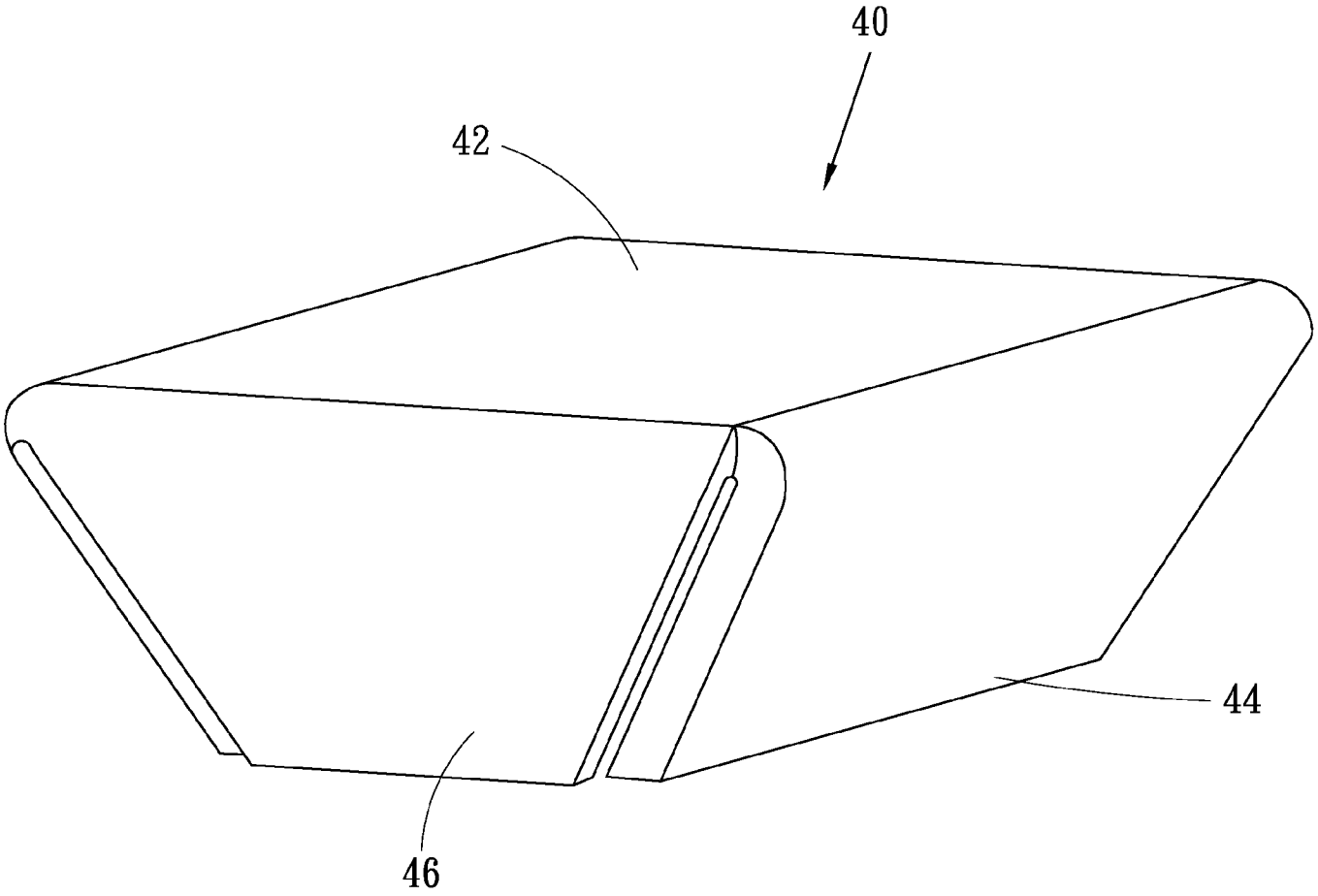
FIG. 7 is a perspective view of a restraining element of a shock-reducing claw hammer according to the third embodiment of the present invention.

Referring to FIG. 7, there is a shock-reducing claw hammer 10 according to a third embodiment of the present invention. The third embodiment is like the first embodiment except that the lateral tabs 46 are trapezoid instead of rectangular.

Figure 8:
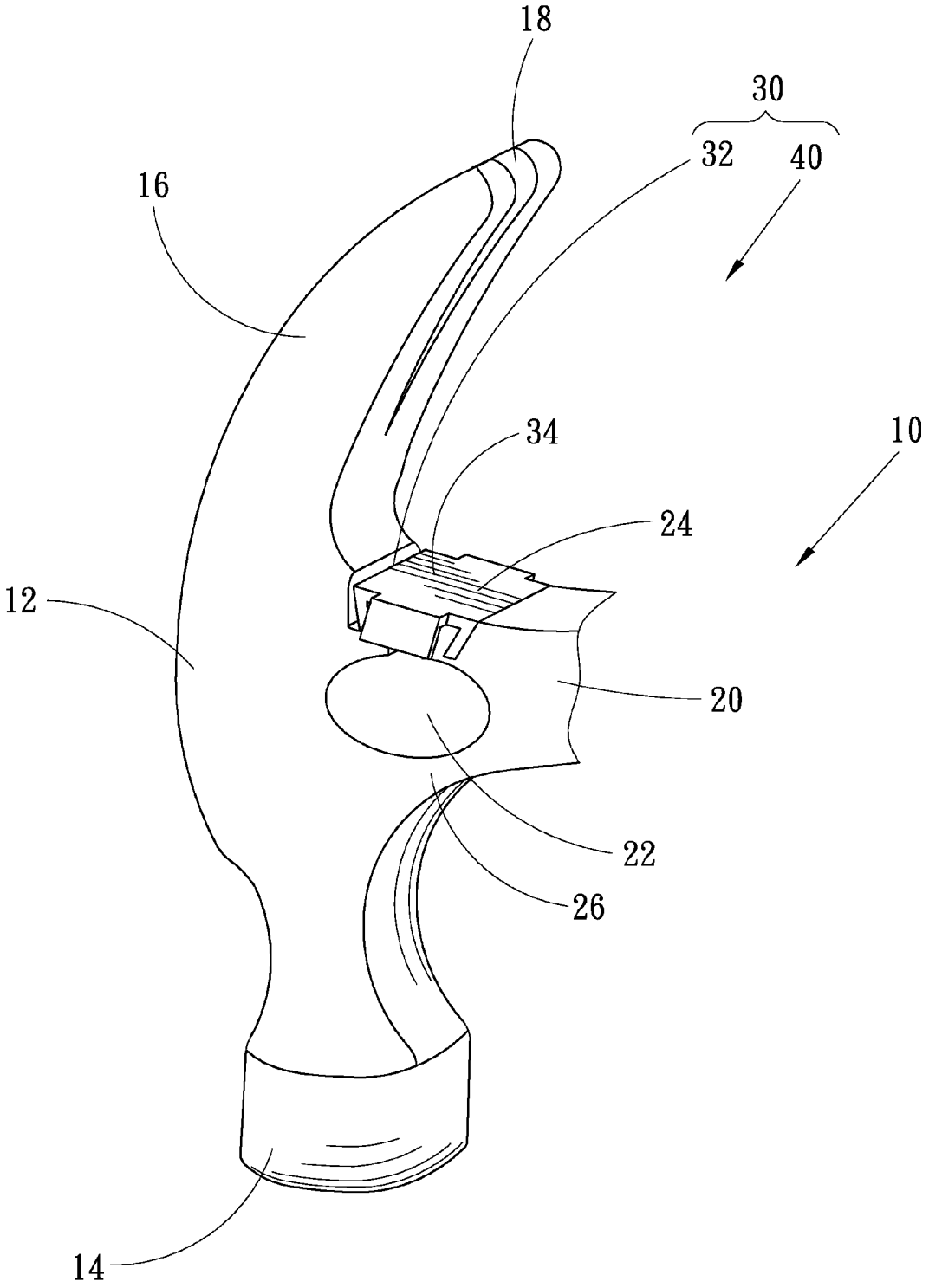
FIG. 8 is a partial and perspective view of a shock-reducing claw hammer according to the fourth embodiment of the present invention.

Referring to FIG. 8, there is a shock-reducing claw hammer 10 according to a fourth embodiment of the present invention. The fourth embodiment is like the first embodiment except that the bore 22, the gap 24, the reduced portion 26 and the restraining device 30 are located closer to the hammerhead 12.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A shock-reducing claw hammer including:

a hammerhead including a hitting portion formed at an end and two claws formed at another end;

a handle connected to the hammerhead and formed with a wide slit, a narrow slit, a bore, a gap in communication with the bore between the slits, and a reduced portion so that the bore is located between the gap and the reduced portion; and a restraining element including a flat body and two end tabs extending from the flat body, wherein the flat body is supported on the handle, one of the end tabs is movably inserted in the wide slit, and the other end tab is fitted in the narrow slit.

2. The shock-reducing claw hammer according to claim 1, wherein the slits get closer to each other as they extend towards the bore.

3. The shock-reducing claw hammer according to claim 2, wherein the handle includes a wedge-like portion between the gap and each of the slits.

4. The shock-reducing claw hammer according to claim 3, wherein the restraining element includes two lateral tabs extending from the flat body, wherein each of the lateral tabs is in contact with the wedge-like portions.

5. The shock-reducing claw hammer according to claim 1, wherein one of the wide and narrow slits is located closer to the hammerhead than the other slit.

6. The shock-reducing claw hammer according to claim 1, wherein the flat body is flush with the handle.

* * * * *